US008342893B2

(12) United States Patent
Glick et al.

(10) Patent No.: US 8,342,893 B2
(45) Date of Patent: Jan. 1, 2013

(54) STAMPED ELECTRICAL TERMINAL

(75) Inventors: Michael Glick, Farmington Hills, MI (US); Slobodan Pavlovic, Novi, MI (US); Cecil Lamar Brown, II, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 13/070,576

(22) Filed: Mar. 24, 2011

(65) Prior Publication Data

US 2012/0003880 A1 Jan. 5, 2012

Related U.S. Application Data

(60) Provisional application No. 61/364,915, filed on Jul. 16, 2010, provisional application No. 61/360,938, filed on Jul. 2, 2010.

(51) Int. Cl.
*H01R 13/33* (2006.01)

(52) U.S. Cl. ..... 439/840

(58) Field of Classification Search ..... 439/840, 439/843, 846, 841
See application file for complete search history.

(56) References Cited

U.S. PATENT DOCUMENTS

| | | | |
|---|---|---|---|
| 2,914,344 | A | 11/1959 | Anthes |
| 3,382,479 | A | 5/1968 | Cooney |
| 4,093,337 | A | 6/1978 | Jacobson |
| 4,384,758 | A | 5/1983 | Lee et al. |
| 4,534,603 | A | 8/1985 | Brown et al. |
| 4,698,026 | A | 10/1987 | Rolf |
| 4,857,015 | A | 8/1989 | Michaels et al. |
| 4,934,366 | A | 6/1990 | Truex et al. |
| 5,076,270 | A | 12/1991 | Stutz, Jr. |
| 5,078,622 | A | 1/1992 | Hunt, III et al. |
| 5,139,276 | A | 8/1992 | Balsells |
| 5,226,682 | A | 7/1993 | Marrison et al. |
| 5,249,975 | A | 10/1993 | Baderschneider et al. |
| 5,263,882 | A | 11/1993 | Peterson |
| 5,266,056 | A | 11/1993 | Baderschneider et al. |
| 5,358,224 | A | 10/1994 | Balsells |
| 5,474,309 | A | 12/1995 | Balsells |
| 5,474,479 | A | 12/1995 | Bennett et al. |
| 5,599,027 | A | 2/1997 | Balsells |
| 5,697,804 | A | 12/1997 | Froberg et al. |
| 5,727,821 | A | 3/1998 | Miller |
| 5,816,643 | A | 10/1998 | Itou et al. |
| 6,225,153 | B1 | 5/2001 | Neblett et al. |
| 6,254,439 | B1 | 7/2001 | Endo et al. |

(Continued)

FOREIGN PATENT DOCUMENTS

DE 3531845 A1 3/1987

(Continued)

OTHER PUBLICATIONS

German Office Action for corresponding Application No. 10 2011 077 165.4, mailed Apr. 18, 2012, 8 pages.

*Primary Examiner* — Phuong Dinh
(74) *Attorney, Agent, or Firm* — Brooks Kushman P.C.

(57) ABSTRACT

An electrical terminal operable to facilitate electrical connectivity between the terminal and an electrical connector. The electrical terminal may include a conducting element, such as but not limited to a coil spring, within a open end used to connect to an electrically conducting connector. The conducting element may facilitate electrical connectivity between the inserted connector and the terminal.

15 Claims, 2 Drawing Sheets

U.S. PATENT DOCUMENTS

| | | | | |
|---|---|---|---|---|
| 6,336,832 | B2 | 1/2002 | Nobe | |
| 6,425,443 | B1 | 7/2002 | Hill et al. | |
| 6,648,686 | B2 | 11/2003 | Nishimoto | |
| 6,827,613 | B2 | 12/2004 | Ferderer | |
| 6,835,084 | B2 | 12/2004 | Poon et al. | |
| 7,035,689 | B1 | 4/2006 | Hawkins et al. | |
| 7,110,827 | B2 | 9/2006 | Sage et al. | |
| 7,294,020 | B2 | 11/2007 | Zhao et al. | |
| 7,458,862 | B2 * | 12/2008 | Zhao et al. | 439/840 |
| 2003/0221837 | A1 | 12/2003 | Giroux et al. | |
| 2004/0245686 | A1 | 12/2004 | Balsells | |
| 2005/0242910 | A1 | 11/2005 | Balsells | |
| 2008/0041477 | A1 | 2/2008 | Shotter et al. | |
| 2008/0246231 | A1 | 10/2008 | Sjostedt et al. | |
| 2008/0254670 | A1 | 10/2008 | Balsells et al. | |
| 2008/0255631 | A1 | 10/2008 | Sjostedt et al. | |
| 2009/0048638 | A1 | 2/2009 | Rey et al. | |
| 2009/0258519 | A1 | 10/2009 | Dilmaghanian et al. | |
| 2010/0029127 | A1 | 2/2010 | Sjostedt | |
| 2010/0029145 | A1 | 2/2010 | Balsells et al. | |
| 2010/0279558 | A1 | 11/2010 | Leon et al. | |

FOREIGN PATENT DOCUMENTS

| | | | |
|---|---|---|---|
| DE | 19943373 | A1 | 3/2000 |
| DE | 202006008718 | U1 | 11/2007 |
| DE | 102008061934 | A1 | 7/2010 |
| JP | 2007012366 | A | 1/2007 |
| WO | 2007084085 | A2 | 7/2007 |

* cited by examiner

STAMPED ELECTRICAL TERMINAL

CROSS-REFERENCE TO RELATED APPLICATIONS

This application claims the benefit of U.S. provisional Application No. 61/364,915 filed Jul. 16, 2010, and U.S. provisional Application No. 61/360,938 filed Jul. 2, 2010 the disclosures of which are incorporated in their entirety by reference herein.

TECHNICAL FIELD

The present invention relates to electrical terminals, such as but not limited to terminals of the type having coils springs operable to facilitate electrical connectivity between the terminal and one or more electrical connectors.

BACKGROUND

Electrical terminals are used in a number of applications to facilitate electrical connections between one element and another. Some electrical terminals may be configured to facilitate use with a removable connector of the type that may be repeatedly inserted and removed from electrical engagement with the electrical terminal. The ability of the electrical terminal to facilitate electrical connectivity with such a removable connector can be problematic if an electrical connection area between the terminal and connector has poor connectivity, particularly when tolerance variations or degradation from repeated use causes a mating arrangement between the components to become loose or otherwise insecure.

SUMMARY

One non-limiting aspect of the present invention contemplates providing an electrical terminal that facilitates proper electrical connectivity with a connector.

One non-limiting aspect of the present invention contemplates a stamped electrical terminal configured to electrical connect to a connector. The terminal may include: an electrically conducting body portion stamped to form from a metal sheet, the body portion including a first open end with a first engagement portion having a first width sufficiently sized to provide a first interference fit with the connector; and a resilient conducting element positioned within the first open end having a first opening sized to provide a second interference fit with the connector.

One non-limiting aspect of the present invention contemplates the body portion including a second open end opposite the first open end, the second open end having a second engagement portion with a second width sufficiently sized to provide an third interference fit with a second connector.

One non-limiting aspect of the present invention contemplates the body portion including an inner passageway for fluidly connecting the first open end with the second open end.

One non-limiting aspect of the present invention contemplates the passageway having a third width, the third width being less than each of the first and second widths, and wherein the second width is less than the first width.

One non-limiting aspect of the present invention contemplates an entire axial length of the body portion including a fold line where opposing sides of the electrically conducting body portion are bent together.

One non-limiting aspect of the present invention contemplates the resilient conducting element being a coil spring.

One non-limiting aspect of the present invention contemplates the coil spring applying more normal force to the connector than the first engagement surface.

One non-limiting aspect of the present invention contemplates the body portion having a uniform material thickness substantially throughout.

One non-limiting aspect of the present invention contemplates the body portion including at least one lance to position the resilient element within the first open end.

One non-limiting aspect of the present invention contemplates each of the at least one lance being formed by punching a slot within the body portion such that a side of each slot curls inwardly more towards the resilient conducting element than a side of the body portion on an opposite side of the resilient conducting element.

One non-limiting aspect of the present invention contemplates a terminal for receiving a connector comprising: a conducting material folded end-to-end to form a body portion having an open end shaped to provide an interference fit with the connector; and a flexible conducting element positioned within the open end to facilitate electrical connectivity between the connector and the body portion One non-limiting aspect of the present invention contemplates an inner diameter of the open end at the interference fit being greater than an inner diameter of the flexible element.

One non-limiting aspect of the present invention contemplates the body portion including at least two diametrically opposed lances to position the flexible conducting element within the open end, the lances being formed by punching corresponding holes with the body portion such that a portion of each punched hole folds inwardly to form the corresponding lance.

One non-limiting aspect of the present invention contemplates an inner diameter of the body portion on adjoining opposed sides of the flexible conducting element being equal and greater than an inner diameter of the lances.

One non-limiting aspect of the present invention contemplates a method of forming a terminal operable for electrically connecting to a connector. The method may include: folding a piece of conducting material to form at least a partially hollow body portion having an open end shaped to receive the connector; and positioning a deformable conducting element within the open end to facilitate electrical connectivity between the body portion and the connector.

One non-limiting aspect of the present invention contemplates positioning the deformable conducting element within the open end after folding the flat piece of conducting material to the at least partially hollow body.

One non-limiting aspect of the present invention contemplates positioning the deformable conducting element within the open end prior to folding the flat piece of conducting material to the at least partially hollow body.

One non-limiting aspect of the present invention contemplates folding the deformable conducting element at the same time as the flat piece of conducting material is folded to form the at least partially hollow body portion.

One non-limiting aspect of the present invention contemplates bending two diametrically opposed sections of the body portion inwardly to form diametrically opposed lances that facilitate position the deformable conducting element.

One non-limiting aspect of the present invention contemplates the deformable conducting element being a resilient coil spring.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION

Figure 1:
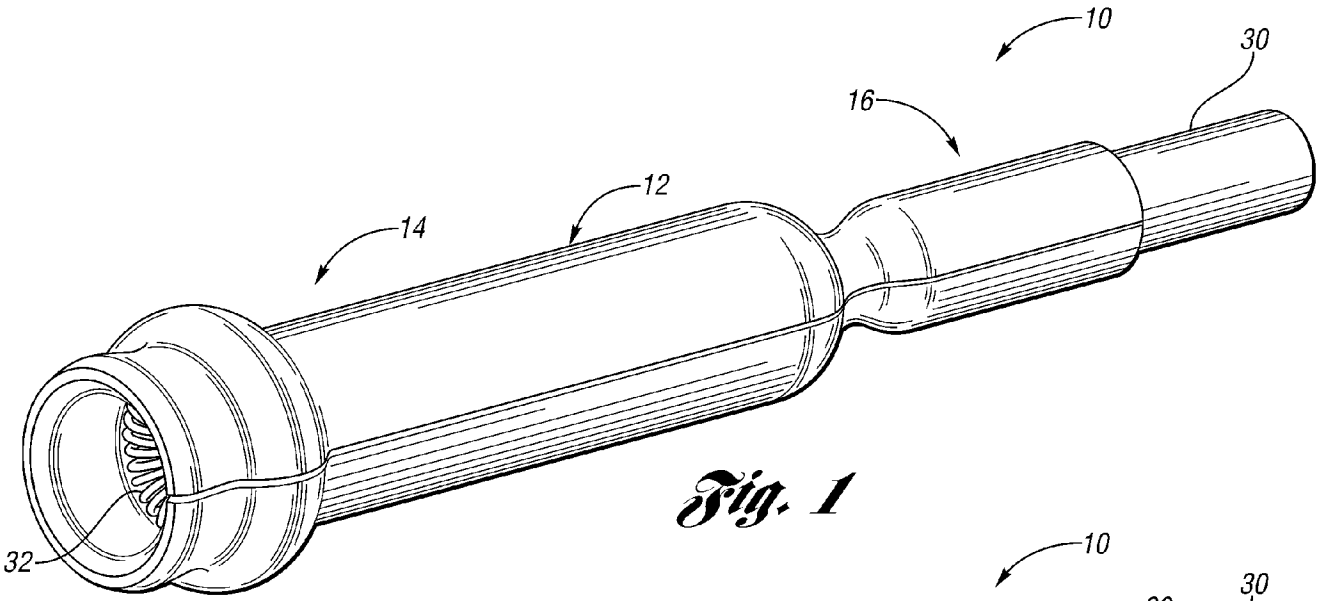
FIGS. 1-4 illustrates an electrical terminal 10 contemplated by one non-limiting aspect of the present invention.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-4 illustrates an electrical terminal 10 contemplated by one non-limiting aspect of the present invention. The electrical terminal 10 may be configured in accordance with the present invention to facilitate electrically interconnecting first and second connectors (not shown), such as but not limited to one being a high current terminal suitable for use in hybrid electric vehicle charge couplers, optionally conforming to the Society of Automotive Engineers (SAE) standard SAE J1772. The electrical terminal 10 may be comprised of a conducting body portion 12 having integrally formed first and second ends 14, 16 configured to facilitate respectively establishing a removable electrical connection with the first and second connectors.

The electrical terminal 10 may be formed by folding a flat piece of conducting material, typically a flat piece, as part of a stamping or other bending operation into the illustrated shape. The folding or stamping operation may be achieved by forming or shaping the material in a die or other fixture sufficient to provide the desired configuration. The illustrated configuration may be considered as an end-to-end fold since opposing ends 20, 22 of the body portion 12 are folded together or proximate to each other. This operation may result in a fold line or fold gap 24 forming between the two ends depending on how closely the two ends are positioned to each other.

Figure 2:
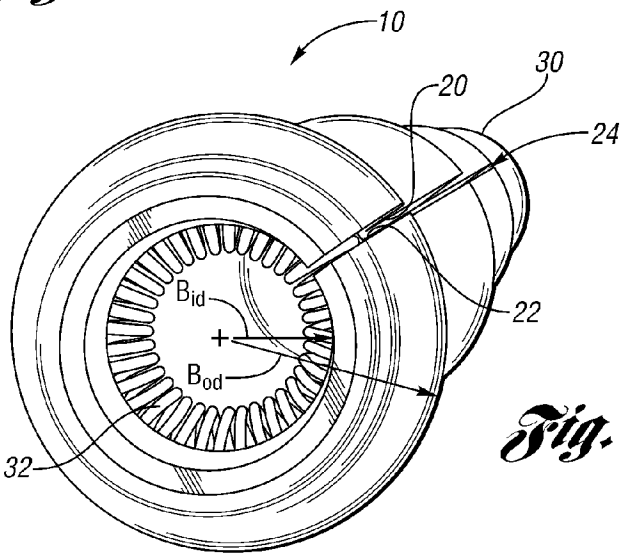
Figure 3:
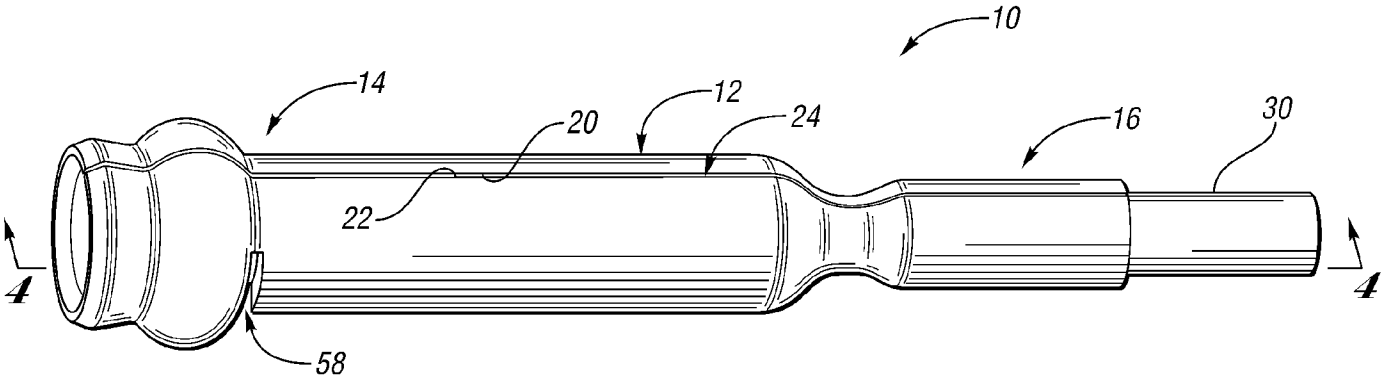
Figure 4:
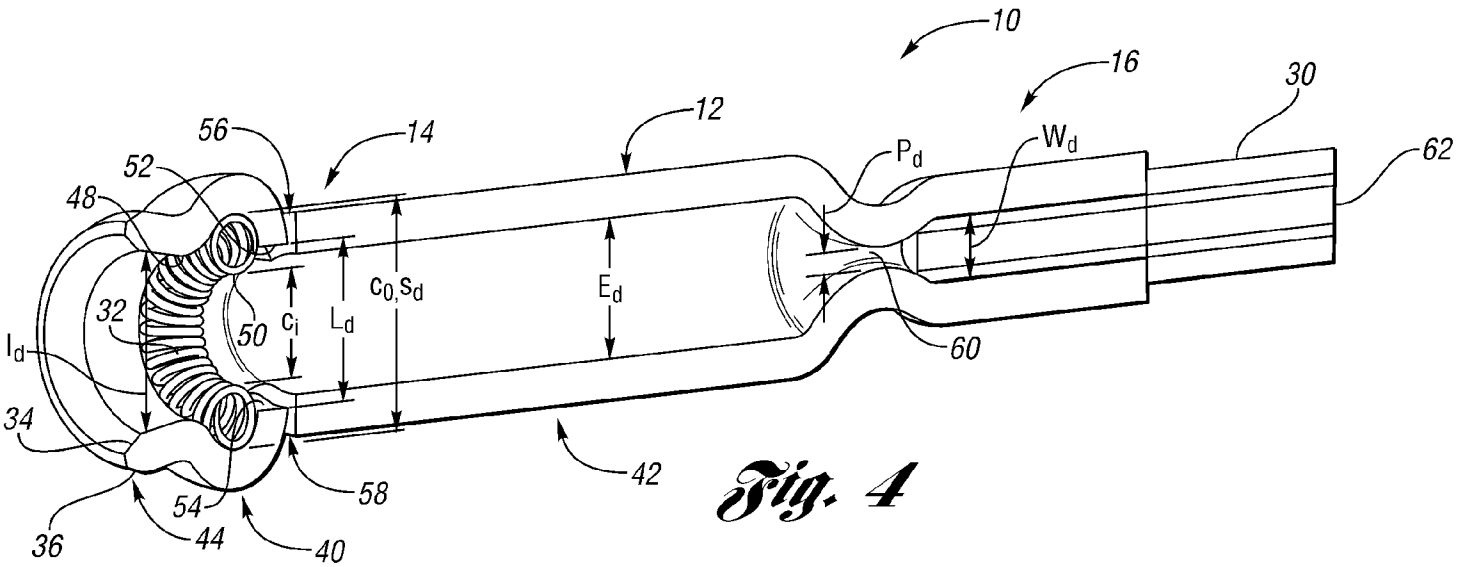

FIG. 2 illustrates and angle-to-angle fold line 24 that extends axially along an entire length of the body portion 12. The angle-to-angle orientation corresponds with a gap between the end pieces 20, 22 increasing from an inner diameter $B_{id}$ to an outer diameter $B_{od}$ due to a radius or curvature of the body portion 12 resulting from the folding operation. The gap may be helpful in providing an area through which air or other fluid can pass during insertion of one or both of the connectors. The fold line 24 may also be helpful in facilitating a crimping operation where one or both of the open ends 14, 16 are crimped to a wire 30 or other type of connection where permanent deformation of the body is desired.

The described stamping operation for forming the body portion 12 is believed to provide a relatively low cost method for forming the electrical terminal 10 without having to machine a groove or other features needed to position a conducting element 32. Other than an entrance where chamfers 34, 36 may be included for smoothness, such as to facilitate insertion of a pin-shaped connector, the electrical terminal 10 may have a substantially uniform material thickness throughout. Of course, the illustrated configuration is not necessarily intended to limit the scope and contemplation of the present invention as other material, and optionally non-uniform, thicknesses are contemplated.

The open ends 14, 16 are shown to be cylindrically shaped to facilitate generating an interference fit with a corresponding shaped portion of the first and second connectors. The terminal 10 and open ends 14, 16 however, are not intended to be limited to being cylindrically shaped and may be shaped into any other suitable geometry. The second end 16, optionally, may be formed with another connection feature instead of the illustrated bored end, such as but not limited being formed as a solid and/or deformable material that may be welded, affixed, or otherwise connected to the connecting element, including being shaped as a male terminal used for insertion into a mating female terminal or as a wire connector where a wire portion is soldered thereto. As such, the description herein sets forth the illustrated embodiment for exemplary purposes only and without intending to unnecessary limit the scope and contemplation of the present invention.

The conducting element 32 may be positioned within the first open end 14 to facilitate electrical interconnection and connectivity with the body portion 12. The conducting element 32 is shown to be a coil spring but may comprise any suitably sized and shaped conducting element 32 operable to facilitate establishing and/or enhancing the electrical interconnection between the body 12 and the first connector 14. Other such conducting elements may include a conducting elastomer having suspending micro-wires, braided element, etc. The exemplary coil spring 32 is shown to be tubular in shape with an inner diameter $C_i$ and an outer diameter $C_o$. The coil spring 32 may be comprised of any suitably conducting material and/or resilient material capable of flexing/deforming during connector insertion and thereafter unflexing, at least partially, when the connector is removed. The resiliency of the coil spring 32 may be beneficial in preventing tolerance variations or degradation resulting from repeated use from causing the electrical connection between the body and the first connector to become loose or otherwise insecure.

The body portion 12 may be formed to include a coil spring portion 40, an engagement portion 42, and an entrance portion 44. The engagement portion 42 may have a diameter/width $E_d$ sufficient to generate an interference fit with the first connector. The coil portion 40 may have a diameter/width $S_d$ sized relative to the outer and inner diameters $C_o$, $C_i$ of the coil spring to facilitate positioning the coil spring 32 relative to the first connector in a manner that facilitates the desired electrical interconnection with the body portion 12 without requiring an undesirable amount of force to insert the connector. The diameter $S_d$ of the coil spring portion 40 may be slightly larger than the diameter $E_d$ of the engagement portion to facilitate insertion of the spring, which also may require a slight compression of the spring 22 during insertion. The entrance portion 44 may have a diameter/width $I_d$ slightly larger than the diameter/width $E_d$ of the engagement portion 42 to facilitate easier insertion of the first connector.

Opposed sides 48, 50 of the coil spring portion 40 on either side of the coil spring 32 may be shaped during the stamping operation to provide a nesting space for the coil spring 32. A left side 48 may have a diameter/width $L_d$ that mirrors the right side, optionally with the exception of diametrically opposed portions of the right side where lances 52, 54 are formed. The lances 52, 54 may be formed by punching, bending, or otherwise folding portions 56, 58 of the body portion 12 such that a diameter/width $L_d$ between the lances 52, 54 is less than the diameter/width $I_d$ of the opposed sides 48, 50, optionally the lances 52, 54 have a smaller radius of curvature than opposed portion of the other side 48 such that the lances 52, 54 curve inwardly further. Of course, the lances 52, 54 may have other shapes such as but not limited to a planar or flat-angled surface. The lances 52, 54 may be helpful in facilitation positioning of the spring 32 within the open end 14. The positioning of the spring 32 within the open end 14 may be easily varied by changing the position of the corresponding lances 52, 54 and sides 48, 50 such that the present invention is able to position the coil spring virtually anywhere within the body portion 12 without regard to machining complexity.

The body portion 12 may optionally be formed with an internal passageway 60 between the first open end 14 and the second open end 16. The internal passageway 60 may establish a fluid flow path between the first and second open ends 14, 16. As shown, the passageway 60 may be shaped such that its diameter/width $P_d$ is slightly less than a diameter/width $W_d$ of a copper wire portion 62 of the wire 30. This may be done to provide a stop or other restrain on an insertion depth of the second connector or to facilitate a removable connection with another terminal or feature of the second connector, such as to facilitate removably connecting the terminal 10 to the second connector when the second connector is part of a charging station or other device.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A stamped electrical terminal configured to electrically connect to a connector, the terminal comprising:
- an electrically conducting body portion stamped from a metal sheet, the body portion including a first open end with a first engagement portion having a first width sufficiently sized to provide a first interference fit with the connector; and
- a resilient conducting element positioned within the first open end having a first opening sized to provide a second interference fit with the connector;
- wherein the body portion has a uniform material thickness substantially throughout;
- wherein the body portion includes at least one lance to position the resilient element within the first open end; and
- wherein each of the at least one lance is formed by punching a slot through a thickness of the body portion such that a side of each slot curls inwardly more towards the resilient conducting element than a side of the body portion on an opposite side of the resilient conducting element.

2. The terminal of claim 1 wherein the body portion includes a second open end opposite the first open end, the second open end having a second engagement portion with a second width sufficiently sized to provide an third interference fit with a second connector.

3. The terminal of claim 2 wherein the body portion includes an inner passageway for fluidly connecting the first open end with the second open end.

4. The terminal of claim 3 wherein the passageway has a third width, the third width being less than each of the first and second widths, and wherein the second width is less than the first width.

5. The terminal of claim 1 wherein an entire axial length of the body portion includes a fold line where opposing sides of the electrically conducting body portion are bent together.

6. The terminal of claim 1 wherein the resilient conducting element is a coil spring.

7. The terminal of claim 6 wherein the coil spring applies more normal force to the connector than the first engagement surface.

8. The terminal of claim 5 wherein a gap is provided along the fold line for passage of fluid during insertion of the connector.

9. A terminal for receiving a connector comprising:
- a conducting material folded end-to-end to form a body portion having an open end shaped to provide an interference fit with the connector; and
- a flexible conducting element positioned within the open end to facilitate electrical connectivity between the connector and the body portion;
- wherein the body portion includes at least two diametrically opposed lances to position the flexible conducting element within the open end, the lances being formed by punching corresponding holes through a thickness of the body portion such that a portion of each punched hole folds inwardly to form the corresponding lance.

10. The terminal of claim 9 wherein an inner diameter of the open end at the interference fit is greater than an inner diameter of the flexible element.

11. The terminal of claim 9 wherein an inner diameter of the body portion on adjoining opposed sides of the flexible conducting element are equal and greater than an inner diameter of the lances.

12. A method of forming a terminal operable for electrically connecting to a connector, the method comprising:
- folding a piece of conducting material to form at least a partially hollow body portion having an open end shaped to receive the connector;
- positioning a deformable conducting element within the open end to facilitate electrical connectivity between the body portion and the connector,
- wherein the deformable conducting element is a resilient coil spring;
- bending two diametrically opposed sections of the body portion inwardly to form diametrically opposed lances that facilitate position the deformable conducting element; and
- punching an aperture through a thickness of the body portion adjacent the lances.

13. The method of claim 12 further comprising positioning the deformable conducting element within the open end after folding the flat piece of conducting material to the at least partially hollow body.

14. The method of claim 12 further comprising positioning the deformable conducting element within the open end prior to folding the flat piece of conducting material to the at least partially hollow body.

15. The method of claim 14 further comprising folding the deformable conducting element at the same time as the flat piece of conducting material is folded to form the at least partially hollow body portion.

* * * * *